United States Patent [19]

Catan

[11] Patent Number: 4,989,501

[45] Date of Patent: Feb. 5, 1991

[54] METHOD AND APPARATUS FOR GENERATING AN AIR CURTAIN WITH HEATED AIR

[75] Inventor: Robert S. Catan, Green Lawn, N.Y.

[73] Assignee: Dynaforce Corporation, Old Bethpage, N.Y.

[21] Appl. No.: 427,712

[22] Filed: Oct. 27, 1989

[51] Int. Cl.[5] ..... F24F 9/00

[52] U.S. Cl. ..... 98/36; 126/110 R

[58] Field of Search ..... 98/36; 126/99 D, 110 C, 126/110 D, 104 A, 110 R

[56] References Cited

U.S. PATENT DOCUMENTS

| | | | |
|---|---|---|---|
| 3,405,922 | 10/1968 | Rohrs | 98/36 X |
| 3,727,834 | 4/1973 | Weatherston | 98/36 X |
| 4,450,755 | 5/1984 | Catan | 98/36 |
| 4,458,665 | 7/1984 | Vandervaart | 126/99 D X |

FOREIGN PATENT DOCUMENTS

| | | | |
|---|---|---|---|
| 15988 | 4/1971 | Japan | 98/36 |
| 18260 | 2/1981 | Japan | 126/104 A |
| 243252 | 10/1986 | Japan | 126/110 D |

*Primary Examiner*—Harold Joyce

*Attorney, Agent, or Firm*—Ladas & Parry

[57] ABSTRACT

An air curtain generator is provided in which an arrangement is incorporated for purposes of heating input air so that an air curtain is generated which is formed with heated air. The air is heated by igniting a mixture of combustible gas and air with the combustion products thereof being distributed through an elongated conduit provided with openings through which the combustion products are discharged. Intake air flows over the conduit into an air curtain generator which causes the thusly heated air to be distributed along a rectilinear path to form an air curtain.

14 Claims, 1 Drawing Sheet

METHOD AND APPARATUS FOR GENERATING AN AIR CURTAIN WITH HEATED AIR

FIELD OF INVENTION

This invention relates to air blowing apparatus and methods and more particularly to apparatus and methods for producing air screens, barriers and/or curtains. The invention relates more particularly to methods and apparatus for heating air upon the introduction thereto into an air blowing apparatus for purposes of generating air curtains which are thus formed with heated air or the like.

BACKGROUND

In my earlier U.S. Pat. No. 4,450,755 which issued May 29, 1984 I disclosed a blower apparatus provided for the generation of an air curtain, screen or barrier. The apparatus of the aforemention patent includes a blower in the form of a plurality of blades arranged to describe a cylinder and a guide is provided which encircles the blower but which is open-ended and extends axially beyond the blower to generate an airstream, the width of which is greater than that of the blower. In addition in the apparatus of the aforementioned patent a deflector or interceptor plate is arranged which is coextensive with that portion of the guide which extends beyond the blower and which is coextensive with a portion of the blower in a moderate range thereof. The deflector or interceptor plate prevents air from circulating in an axial direction back into the blower and therefore improves the effectiveness of generation of the airstream which flows tangential out of the blower arrangement.

In the aforesaid patent the casing which houses the fan is provided with an intake opening covered with a screen and capable of admitting intake air This intake air flows into the casing at an angle which is perpendicular to the discharge of such air in the form of an air curtain or the like. In the apparatus of U.S. Pat. No. 4,450,755 the temperature of the air relies upon ambient conditions in the space in which the air blowing apparatus is installed. This means, since there is no provision for controlling the temperature of the air which is employed and discharged, that the temperature of the air curtain depends upon the temperature of the air which is fed into the system without any control being exercised thereupon. Accordingly it is frequently possible and even usual that the air of the air curtain which is generated is cold air which may be uncomfortable and humid and which is hardly likely to be ergonometrically qualified to offer the most suitable conditions for employees and the like who in the performance of whatever functions are assigned to them may have to pass through the opening which is being protected by the air curtain which is being generated.

SUMMARY OF INVENTION

It is an object of the invention to provide improved air blower arrangements and methods for producing air screens and the like.

It is another object of the invention to provide improved apparatus and methods for the generation of air curtains and the like with temperature control thereof It is yet another object of the invention to supplement the operation of an air blower apparatus and related methods by the provision of a heat generator which functions to add heat to intake air.

In achieving the above and other of the objectives of the invention there is provided generally and as will be described in greater detail hereinbelow an apparatus which comprises an air curtain generating arrangement for directing a flow of air along a path to constitute an air curtain or the like, the air curtain generating arrangement having an intake opening for the intake of air, and a heating arrangement to heat air for supply to the intake opening and thence to the aforementioned path. The heating arrangement of the invention will preferably include structure to burn a mixture of gas and air to add the combustion products thereof to the air being supplied to the intake opening. More specifically, the heating arrangement may include an elongated conduit provided with an axial bore and radial openings, a supply of combustible gas coupled to this axial bore, and apparatus to burn the gas in mixture with air to provide heated combustion products which are supplied to the intake opening.

According to a specific embodiment of the invention the heating arrangement includes a casing enclosing the conduit and having an opening for the admission of air. As a feature of this embodiment a shield arrangement is provided within the casing for protecting the casing from heat which is radiated by the conduit.

According to other features of the invention as will be described in greater detail hereinbelow, the shield arrangement may include preferably two arcuate shields bracketing the conduit and forming inflow and outflow paths to supply air to and around the conduit and to enable the air to continue on into the aforementioned intake opening of the air curtain generator arrangement.

According to another feature of the invention the air curtain generating arrangement has an effective length along which the conduit extends at least substantially fully and in parallel. It will be noted in the preferred embodiment which is described hereinafter that the casing of the heating arrangement is generally equal in size and shape to the casing of the air curtain generator arrangement. It will also be noted that these casings are horizontally arranged in parallel and in juxtaposition with the casing of the air curtain generating arrangement directing the air curtain vertically downwards.

In accordance with the method of the invention there are comprised the steps of heating air and causing the thusly heated air to flow along a rectilinear path as an air curtain The air is preferably heated according to the invention by burning combustible gas to form heated combustion products which are discharged into the air which is ultimately caused to flow along the aforementioned rectilinear path. The gas is preferably burned by mixing a combustible gas with air and igniting the thusly resulting mixture According to other aspects of the invention and as has been generally indicated hereinabove, the combustion products are directed through a conduit provided with openings with the air which is to be heated being caused to flow around the conduit. It will also be noted that the air which is to be heated is passed around the conduit in a direction at right angles to the general flow of combustion products through the conduit and that the air curtain is directed vertically downwards.

Other features of the invention include intercepting radiation from the conduit to limit radial transmission thereof and aligning the conduit in parallel with the air curtain.

Other objects, features and advantages of the invention will be found in the following detailed description of a preferred embodiment thereof as illustrated in the accompanying drawing.

DETAILED DESCRIPTION

In U.S. Pat. No. 4,450,755 is shown a casing having an inlet opening and a discharge opening arranged such that air is discharged along a rectilinear path at right angles to the entry direction of intake air into a casing which is provided to shield the functional elements of the air blower arrangement disclosed in this patent. Further shown are a plurality of fan arrangements connected together for simultaneous rotation whereby intake air is caused to be whirled centrifically. This air is cast off and is directed by a scroll arrangement to follow a path which leads to discharge as an air curtain. Deflector plates are provided which extend beyond the axial extents of the fans to increase the effective widths of the air curtain. These deflectors prevent the air from moving out of the air curtain path to be redirected for undesired recirculation into the various fans.

As has been mentioned hereinabove, the temperature of the air as well as the humidity conditions thereof depend upon the nature of the intake air being supplied to the air curtain generator. This may frequently be undesirable since the blowing of cold moist air in the form of an air curtain may seriously affect the environmental conditions as well as health conditions in which factory personnel and the like may have to work especially when their duties cause them to pass through the air curtains being generated.

Figure 1:
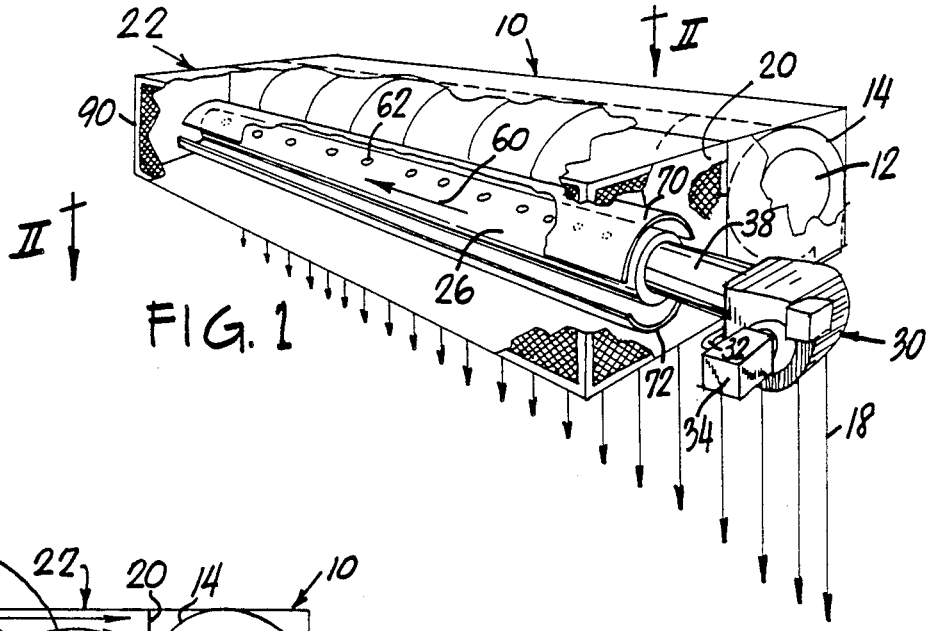
FIG. 1 is a partially diagrammatic perspective view of a preferred embodiment of the invention.
Figure 2:
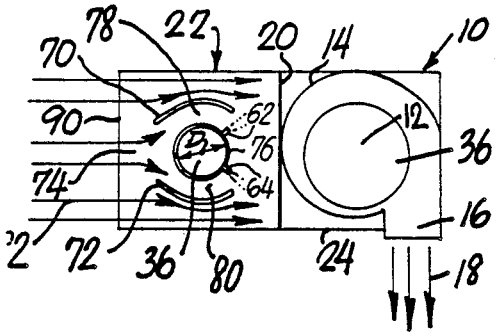
FIG. 2 is a diagrammatic sectional view taken along line II—II of FIG. 1.

The air blower arrangements or air curtain generator of U.S. Pat. No. 4,450,755 is shown diagrammatically at 10 in the attached drawing. In some of the Figures, notably FIGS. 1 and 2, a fan arrangement 12 is shown therein encircled by a scroll arrangement 14 which causes the circulated air to pass through an opening 16 and to follow a rectilinear path downwardly and vertically as indicated by the arrows at 18. In the prior embodiment this intake air passes through an opening indicated at 20 which may be in the form of a screen or the like which screens out undesirable impurities such as leaves, scraps of paper, insects and the like. The path which the intake air follows through the opening 20 is perpendicular to the direction indicated by arrows 18 and is therefore generally horizontal.

In accordance with the invention there is provided a further casing 22. This casing 22 is generally square or rectangular in cross section as is the casing 24 of the air blower arrangement 10. These two casings 22 and 24 are generally and preferably of the same order of magnitude of.-size and/or cross section.

In further accordance with the preferred embodiment of the invention the casings 22 and 24 are elongated thereby to provide an elongated air curtain the length of which exceeds the length of the fan arrangement 12 by reason of the provision of the deflector plates which operate as set forth in detail in U.S. Pat. No. 4,450,755.

According to a feature of the invention there is provided extending longitudinally through the casing 22 an elongated conduit 26 fabricated for example of a lightweight metal such as thin steel or possibly aluminum and preferably fabricated of a plastic such as polyethylene, polystyrene or the like capable of withstanding elevated temperatures the nature of which will become hereinafter apparent. This conduit will have a wall strength capable of making the weight of the conduit self-sustaining and will have a diameter D which is capable of permitting the development of a pneumatic head which is capable further of permitting a radial discharge of combustion products as will be explained more fully hereinbelow.

An important component of the invention is indicated at 30. Component 30 is a heating arrangement which takes in a supply of ambient air and mixes the same with a combustible gas fed via pipe 32 under the control of an electrical control 34. The combustion mixture is forced out and into the internal bore 36 of the conduit 26 via a tube 38 which is inserted internally of the bore 26. The function of heating arrangement or burner 30 is to take a mixture of combustible gas and air, mix the same and controllably ignite the same while supporting the combustion thereof in a nozzle thereby to cause the generation of a flame and the issuance of heated combustion products.

Figure 5:
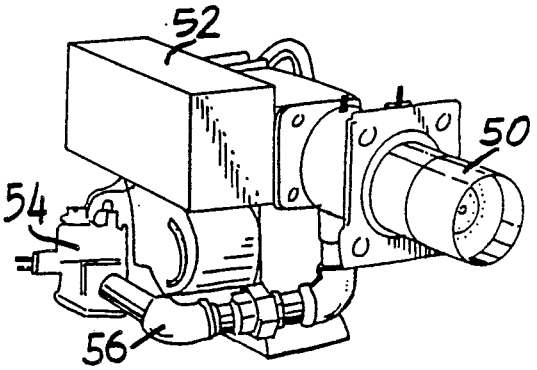
FIG. 5 is a perspective partially diagrammatic view of a burner constituting a heating arrangement component in accordance with the invention.
Figure 3:
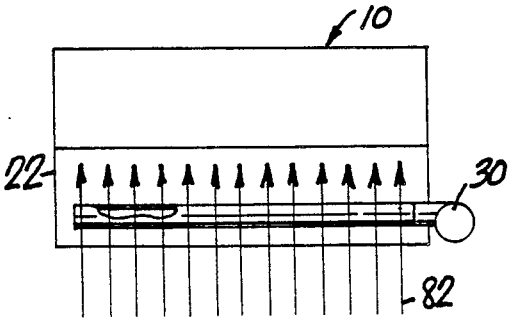
FIG. 3 is a diagrammatic top view of the structure of FIGS. 1 and 2.
Figure 4:
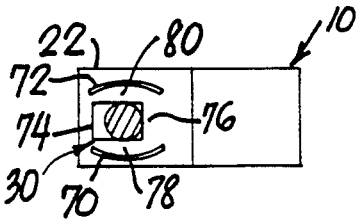
FIG. 4 is a diagrammatic end view of the apparatus of the invention as illustrated in FIG. 3.

By reference to FIG. 5 one will note a perspective view of a commercially available burner which may be utilized in accordance with the precepts of the invention. One such burner is Model OE-B produced by the American Burner Corp. of Commack, N.Y. This model is capable of providing by way of example a heat output of 200,000–400,000 BTU/hr of natural gas origin. It is provided with a crown head indicated at 50 for the generation and retention of a flame for compact combustion. It is furthermore provided with a spark ignition under the control of a unit 52 and a solenoid control 54 for the supply of natural gas or other such combustible gas via a pipe 56. The unit is provided with a one-quarter horsepower motor although larger or smaller sizes may equally well be provided. It is also provided with a pre-purge air system and a flame rod control (not shown) to facilitate the functioning of the apparatus.

The flame which is generated and the combustion products which result pass axially through the conduit 26 as shown generally by the arrow 60. The remote end of the conduit 26 is preferably obturated. The conduit is however provided with a multitude of radial openings 62 and 64. These openings may be aligned in parallel rows or alternatively may be arranged in spiral or other such patterns around the conduit. Their sizes may be varied along the length of the conduit 26 thereby to accommodate decreasing pneumatic head from one end of the conduit to the other. The bore of the conduit may range for example from 3 to 24 inches. The openings 62 and 64 may for example range between ⅛ and 2½ inches. These size ranges may be exceeded in either direction without surpassing the scope of the invention. What is essential is that sufficiently heated combustion products and accompanying unburned air will be mixed with intake air to supply an air curtain of desired temperature having the humidity thereof generally abated or minimized.

The flow of heated combustion products through the conduit 26 may cause a radial radiation of heat which might undesirably heat the outer casing 22. To avoid this undesired radiation as well as perform another function to be mentioned hereinbelow there may be provided a plurality of shields. Two arcuate shields 70 and 72 are illustrated. They are spaced from the conduit 26 by a distance which may generally be in the order of magnitude of ¼ to ½ the diameter of the conduit and serve to define an inflow path 74 and an outflow path 76. They also form paths 78 and 80 by means of which intake air indicated by arrows 82 are caused to flow through inflow opening 74 and via paths 78 and 80 around the conduit 26 and thence via outflow opening 76 into the intake opening 20 of the air curtain generator arrangement 10. Thus, the shields 70 and 72 perform the function of shielding the casing 22 from undesired radiation from the conduit 26 and of confining the flow of some of the air around the conduit 26 to provide for ready mixing thereof with heated combustion products flowing outwardly through openings 62. The shields, also provide a further function, this function being that of guiding the flow of air towards the intake opening 20 of generator 10 although this function is aided by the negative pressure created by the fan arrangement 12 of the generator 10.

The opening of casing 22 is generally indicated at 90. This opening is preferably screened also to prevent the entry of undesirable contaminating objects and especially those which may be inflammable. Although not shown, the intake openings may be provided with dampers or other controls which serve to control the magnitude of air flowing into the system thereby to aid in temperature control and pressure. It will be noted also that casings 22 and 24 are mounted in parallel and juxtaposition with each other being furthermore parallel to the air curtain indicated at 18. Similarly, the conduit 26 has an axis of symmetry which is parallel to but spaced from the air curtain 18 so that consequently the conduit 26 is likewise parallel to the air curtain.

It will therefore be observed that the method of the invention comprises heating air and causing the thusly heated air to flow along a rectilinear path as an air curtain while heating the air by burning a combustible gas to form heated combustion products which are discharged into the intake air before it is formed as an air curtain. It will be noted further that the heating is preferably effected by burning the combustible gas (e.g. natural gas, etc.) upon mixing the same with air and igniting the thusly resulting mixture The combustion products which are heated are then directed through a conduit provided with openings through which the heated combustion products escape in a radial direction. Air to be heated is caused to flow around the conduit to mix with and be heated by the escaping combustion products. The air is passed around the conduit in a direction at right angles to the general flow of combustion products through the conduit before they escape radially therefrom.

A feature of the method of the invention involves intercepting radiation from the conduit to limit the radial transmission thereof. The foregoing objects and advantages of the invention are not necessarily limiting of the same since variations may be effected to achieve slightly different objects other than those envisaged above.

There will now be obvious to those skilled in the art many modifications and variations of the structures and methods set forth hereinabove. These modifications and variations will not depart from the scope of the invention if defined by the following claims.

What is claimed is:

1. Apparatus comprising air curtain generating means for directing a flow of air along a path to constitute an air curtain, said air curtain generating means having an opening for the intake of air, and heating means to heat air for supply to said intake opening and thence to said path; said heating means including a conduit provided with an axial bore and radial openings positioned along said conduit, a supply of combustible gas, and burner means coupled to said supply of combustible gas to burn the gas in mixture with air to provide heated combustion products, said burner means being coupled endwise to said conduit so that said combustion products are supplied axially through said axial bore and via said radial openings to the intake opening.

2. Apparatus as claimed in claim 1 wherein said heating means includes a casing enclosing said conduit and having an opening for the admission of air.

3. Apparatus as claimed in claim 2 comprising shield means within said casing for protecting the casing from heat radiated by said conduit.

4. Apparatus as claimed in claim 3 wherein said shield means includes two generally horizontal arcuate shields bracketing said conduit and providing inflow and outflow paths to guide air around the conduit to mix with the combustion and to pass to said intake opening.

5. Apparatus as claimed in claim 1 wherein said air curtain generating means has an effective length along which said conduit extends at least substantially fully, said radial openings being distributed along the length of said conduit.

6. Apparatus as claimed in claim 1 wherein said conduit is parallel to said path and said burner means includes a nozzle extending into said conduit to generate combustion products which are distributed via said radial openings.

7. Apparatus as claimed in claim 2 wherein said air curtain generating means includes a casing generally equal in size to the first said casing.

8. Apparatus as claimed in claim 7 wherein said casings are horizontally arranged in parallel and in juxtaposition, the casing of said air curtain generating means including means for directing the air curtain vertically downwards.

9. A method comprising heating air and causing the thusly heated air to flow along a rectilinear path as an air curtain, said method comprising heating the air by burning a combustible gas to form heated combustion products which are discharged into the air and directing the combustion products through radial openings distributed along a conduit, the air which is to be heated being caused to flow around the conduit to mix with the combustion products.

10. A method ad claimed in claim 9 burning the gas by mixing the gas with air and igniting the same.

11. A method as claimed in claim 9 wherein the air which is to be heated is passed around the conduit in a direction at right angles to the general flow of combustion products through the conduit.

12. A method as claimed in claim 11 wherein the air curtain is directed vertically downwards.

13. A method as claimed in claim 11 comprising intercepting radiation from the conduit to limit radial transmission thereof.

14. A method as claimed in claim 11 comprising aligning the conduit in parallel with the air curtain.

* * * * *